United States Patent [19]

Schuster et al.

[11] Patent Number: 4,539,719

[45] Date of Patent: Sep. 10, 1985

[54] PNEUMATIC SURF WAVE PRODUCTION FOR POOLS

[75] Inventors: Siegfried Schuster; Christian Boes, both of Berlin, Fed. Rep. of Germany

[73] Assignee: Automated Swimpools, Inc., Mansfield, Ohio

[21] Appl. No.: 578,066

[22] Filed: Feb. 8, 1984

[51] Int. Cl.[3] ..... A47K 3/10

[52] U.S. Cl. ..... 4/491; 4/508; 73/148; 405/79

[58] Field of Search ..... 4/491, 494, 492, 508; 405/76, 79; 73/148

[56] References Cited

U.S. PATENT DOCUMENTS

| | | | |
|---|---|---|---|
| 2,056,855 | 10/1936 | Herz | 4/491 |
| 3,473,334 | 10/1969 | Dexter | 4/491 |
| 3,629,877 | 12/1971 | Schuster et al. | 4/491 |
| 3,693,195 | 9/1972 | Richard et al. | 4/491 |
| 4,229,969 | 10/1980 | Hark | 73/148 |
| 4,276,664 | 7/1981 | Baker | 4/491 |
| 4,406,162 | 9/1983 | Hark | 4/491 X |
| 4,467,483 | 8/1984 | Bastenhof | 4/491 |

FOREIGN PATENT DOCUMENTS

| | | | |
|---|---|---|---|
| 2004528 | 8/1971 | Fed. Rep. of Germany | 4/491 |
| 163218 | 10/1933 | Switzerland | 405/79 |
| 375684 | 7/1932 | United Kingdom | 4/491 |
| 1027315 | 7/1983 | U.S.S.R. | 405/79 |

*Primary Examiner*—Henry K. Artis

*Attorney, Agent, or Firm*—Maky, Renner, Otto & Boisselle

[57] ABSTRACT

Method and apparatus for creating in a water pool a wave for surfing, the pool having a reservoir at one end open to the pool beneath the undisturbed water level of the pool, a fan connected to the reservoir for expelling air from it and drawing water from the pool into the reservoir to store water above the undisturbed water level of the pool, and a valve for selectively sealing the reservoir against the intrusion of air and rapidly ventilating the reservoir so that the stored water flows into the pool by gravity at a velocity near its theoretical limit.

10 Claims, 4 Drawing Figures

PNEUMATIC SURF WAVE PRODUCTION FOR POOLS

The present invention concerns a method and apparatus for creating a water wave in a pool of sufficient amplitude and wave contour to permit a person, with the aid of a surf board, to practice the sport of surfing on it.

The creation of waves with parallel wave fronts in swimming pools has long been known. For example, apparatus capable of producing such waves is disclosed in U.K. Pat. No. 375,684 to Bamag-Meguin A. G. accepted June 30, 1932 and in U.S. Pat. No. 2,056,855 to F. K. Herz issued Oct. 6, 1936. These types of waves are to be distinguished from the resonance type waves such as are produced by the method and apparatus disclosed in U.S. Pat. No. 3,629,877 issued Dec. 28, 1971 to the applicants here. None of these cited patents discloses creation of a surfing wave which must have an amplitude of about two meters or more above the undisturbed water level of the pool and have a cross sectional contour suitable for surfing. U.S. Pat. No. 3,473,334 to Dexter issued Oct. 21, 1969, discloses a method and apparatus for creating a surfing wave. There, water is pumped from above into a reservoir located at one end of a pool to create a hydraulic head. A gate beneath the water is then raised to place the reservoir in communication with the pool. The water driven from the reservoir by the hydraulic head flows against a deflector which directs the flow upward to create a surfing wave nearly two meters high. The placement of the gate below the water level creates maintenance problems since moving parts must be serviced under water or the pool drained of a very large amount of water.

SUMMARY OF THE INVENTION

The present invention provides apparatus and methods of producing waves for surfing with maximum efficiency. The high efficiency is obtained by concentrating the energy of a freely falling hydraulic head of water along smooth inside walls of a reservoir that is in submarine communication with a pool of water. The wall more distant from the pool includes a continuously curving surface that is tangentially joined to the adjacent, relatively level portion of the pool floor. This smooth transition avoids turbulence and other losses of energy that occur when the pool floor is not aligned with the inside rear reservoir wall or contains discontinuities. Preferably, the lower extremity of the front reservoir wall, besides being smooth, also terminates in a continuous curve curving only toward the pool to avoid the creation of turbulence.

A hydraulic head is created in the reservoir by sealing the reservoir against the intrusion of air and evacuating air from the reservoir. The partial vacuum created causes water to enter the reservoir above the normal, i.e. undisturbed, level of water in the pool and be stored. When a hydraulic head of the desired height has been created by the evacuation of air from the reservoir, the reservoir is suddenly vented to the atmosphere so that the stored water flows downward under the influence of gravity and transfers energy to the water in the pool to create a surfing wave. Preferably a vent having an area of at least one third the horizontal cross sectional area of the reservoir is opened, so that the stored water can flow without being restricted by the rate at which air enters the reservoir. The described reservoir characteristics permit the water to reach a velocity as near its theoretical maximum as possible for maximum energy efficiency and transfer.

A preferred design for a vent includes a relatively large aperture having a lid that is held against an aperture in the reservoir by atmosphere pressure when the pressure in the reservoir is reduced. A spring or other biasing force urges the cover away from the reservoir. A relatively small aperture in the reservoir is connected to the atmosphere through a valve such as a solenoid valve. After the pressure has been reduced in the reservoir, the valve is rapidly opened. A sudden rise in pressure inside the reservoir releases the lid under the influence of the spring so that the large vent is opened without the application of a large force. The interval between the opening of the valve and release of the lid is too short to permit any significant flow of water from the reservoir.

DETAILED DESCRIPTION OF PREFERRED EMBODIMENTS

Figure 1:
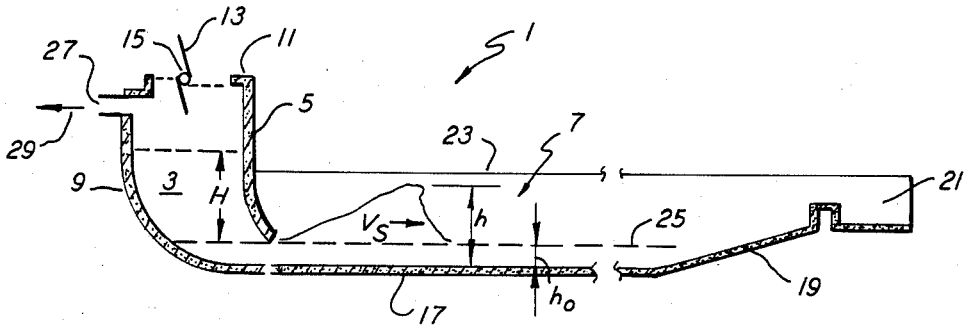
FIG. 1 is a cross sectional, schematic side view of a preferred embodiment of surf wave producing apparatus according to the invention.

A cross sectional side view of a surfing pool 1 is shown in FIG. 1. The pool includes a reservoir 3 having a front wall 5 toward a pool 7 and rear wall 9 away from pool 7. A top 11 of reservoir 3 may be opened or closed by a butterfly type valve having a vane 13 mounted on an axle 15. Pool 7 has a floor 17 that is substantially level adjacent to reservoir 3 but which inclines upward in a sloped portion 19 at a distance from the reservoir as is known in wavepools. A sump 21 at the extreme end of pool 7 collects water that overflows the pool end when a surface wave propagates to the end of the pool.

In order to produce efficiently a surfing wave, that is, a wave having an amplitude of about two meters or more and a contour suitable for surfing, it is necessary to transfer energy to the pool with maximum velocity and minimum losses to turbulence and friction. It is known to produce waves in pools by creating a hydraulic head, that is, storing water above the level of the quiet or undisturbed water in a pool, and releasing the head. It is also known that the maximum velocity for a wave having an amplitude h measured from the bottom of the pool $V_s$ is $\sqrt{gh}$, where g is the gravitational acceleration. Obviously this relation is limited to relatively shallow depths for in deep water such as the ocean there are no waves. However, this relationship is useful in a design for creating a surfing wave having maximum energy and the velocity necessary for surfing. For a surfing wave of a desired height, the hydraulic head necessary can be determined from the known relationship between the height of a hydraulic head and the freely falling velocity of flow from it. Namely, $$V_A = \sqrt{2gH(1 - H_v/H)}$$

where $V_A$=the velocity of flow

H=the height of the hydraulic head, and g=gravitational acceleration $H_v$=equivalent head height lost to flow resistance.

In order to achieve the maximum wave velocity, $v_s=v_a$ with a particular head height, an assumption as to the flow losses must be made. A generous assumption allowing a large margin of safety is $H_v=H/2$, that is that half the equivalent head height is wasted in the flow. Then to achieve a discharge velocity from the reservoir equal to the maximum theoretical wave velocity, $H \geqq h$. It is also necessary to reduce the flow resistance and turbulence to a minimum to achieve the desired energy transfer from the downwardly flowing water into the pool. In reality, it is more correct to refer to an energy transfer than water flow since little change in the total volume of water results from release of water stored in the reservoir into the pool.

The quantities just mentioned are further identified in FIG. 1, where $h_o$ is the level of water in the pool when it is not disturbed by a surfing wave. (In addition, the far lateral side of the pool edge 23 is shown to illustrate that the wave crest preferably does not flow over the sides of the pool. Were that overflow to occur the desired wave contour at the ends of the parallel wave would be destroyed before the wave reaches sump 21.)

It is disclosed in U.K. Pat. No. 375,684 and U.S. Pat. No. 2,056,855 to draw water into a reservoir by pneumatic means and we prefer to use that technique here. Reservoir 3 is open to pool 7 beneath the undisturbed water level 25. As shown in FIG. 1, front wall 5 terminates in a lower extremity below and, preferably just below water level 25. In addition, it is preferred that the lower extremity of front wall 5 terminate in a continuous curve bending toward pool 7 to improve the flow of water from reservoir 3 and avoid turbulence. Likewise, the interior surfaces of walls 5 and 9 are preferably smooth. Reservoir 3 may be constructed in a conventional way from poured concrete. Rear wall 9 at its lower extremity has a continuous curved portion bending toward pool 7. As emphasized by the gap in FIG. 1 between wall 9 and pool floor 17, a gap which does not exist in an actual pool, floor 17 is substantially level adjacent wall 9 and is tangentially joined to it. Therefore water flowing from reservoir 3 does not descend to a lower pool floor, as shown in U.K. Pat. No. 375,684 and U.S. Pat. No. 2,056,855. Thereby a substantial loss of energy is avoided. Moreover, neither of those patents discloses any ability to produce a surfing wave which may be attributable to the energy lost in the falling water which must rise again to produce the waves. See U.S. Pat. No. 2,056,855 at page 3, left column, lines 10 to 17 where the only producable wave patterns are slow rolling or rapid choppy waves. Likewise, with our design, no deflector such as is disclosed in U.S. Pat. No. 3,473,334 is necessary to create a surface wave. The deflection of flow consumes energy and reduces the efficiency of the apparatus, a problem avoided in our design.

Reservoir 3 includes an outlet 27 above the highest water level in the reservoir that is connected to conventional suction means such as a fan or vacuum pump that is not illustrated. The suction means extract air from the reservoir in the direction indicated by arrow 29, preferably continuously as in U.K. Pat. No. 375,684. Reservoir 3 may be sealed from intrusion of air from the atmosphere by the closing of the butterfly valve. Axle 15 is rotated to place vane 13 across the opening in top 11 of reservoir 3 as indicated by the broken lines of FIG. 1. Then as air is extracted a partial vacuum is created so that water is drawn into reservoir 3 to a height H above the undisturbed water level $h_o$. The water can flow into the reservoir from pool 7 or it may be drawn through pipes from sump 21. In either case, the level of the pool water is not noticeably reduced.

Figure 2:
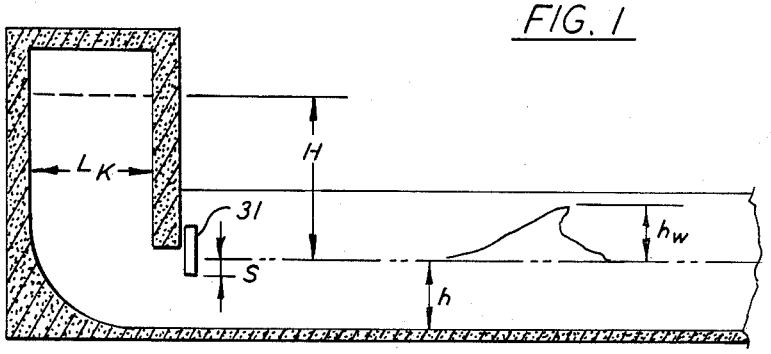
FIG. 2 is a cross sectional, schematic side view of an embodiment of model surf wave producing apparatus according to the invention upon which measurements have been made.

When the hydraulic head reaches the desired height H, the butterfly valve is suddenly opened to admit atmospheric air into reservoir 3 so that the stored water is released and the energy of its downward flow is transformed into a surf wave. We have had tests of the operation of our new surf pool design conducted to determine if it would function as desired. The pool was built on a 1:10 scale, was 5 m in length, 50 cm wide and the reservoir projected about 70 cm out of the water. Suction was obtained from an industrial vacuum cleaner and a flap closing the top of the reservoir was manually opened when the desired head height was achieved. A cross sectional sketch of the pool is shown in FIG. 2. The depth, $L_K$, of pool reservoir for these tests was 47 cm. It should be noted that some of the symbols used in FIG. 1 were used in reporting these test results, but given different definitions in the tests. In these tests, h is the depth of the undisturbed water which was 25 cm. The test model included a shutter 31 that could be vertically adjusted to different depths below the surface of the water. In these tests, the shutter projected into the water a distance s of 4 cm. In the tests the height H of the hydraulic head was varied. The results were as follows:

| H (cm) | $h_w$ (cm) |
|---|---|
| 50 | 21* |
| 38 | 21* |
| 35 | 18 |
| 26 | 16 |
| 30 | 18 |
| 35 | 19 |
| 38 | 21* |
| 45 | 21* |

In the results marked with a star, the wave actually spilled over the side walls of the pool. When these tests are scaled up to a full size pool, then a surfing wave of 2.1 m should be obtained. The contour of the waves observed in these tests was satisfactory for surfing. A hydraulic head of 3.8 to 5 m, plus some margin for scaling-up losses, would be required to produce a full scale surfing wave.

Figure 4:
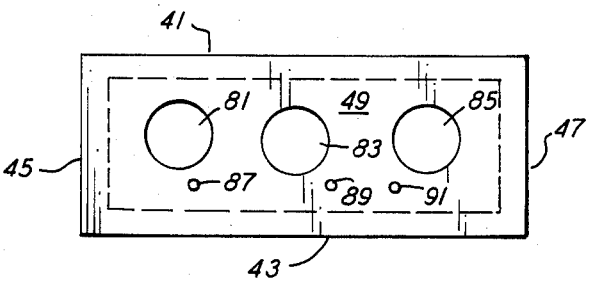
FIG. 4 is a schematic plan view of an embodiment of a reservoir according to the invention.

In operating embodiments of the inventive surf wave apparatus, it is important that a sufficient rate of air flow into the evacuated reservoir be provided to avoid additional energy losses. If the air flows in too slowly when the valve is opened, the rate at which water flows of the reservoir will be retarded and the desired high efficiency energy transfer from the hydraulic head to the surf wave will not be achieved. In order to avoid these energy losses at least one third of the horizontal cross sectional area of the reservoir should be opened to the atmosphere at once. Referring to FIG. 4, a plan view of a reservoir having a front wall 41, opposing rear wall 43 and opposing side walls 45 and 47 joining the front and rear walls, the horizontal cross sectional area is that area enclosed by the broken lines which describe a horizontal perimeter of the interior surfaces of those walls.

A further complication may arise in opening the desired large area of the reservoir to the atmosphere. Referring back to FIG. 1, when vane 13 is closed and reservoir 3 is evacuated, atmospheric pressure tends to interfere with the operation of the valve. The portion of vane 13 on one side of axle 15 will be held closed by atmospheric pressure while the other portion will be pushed open. As a result, an unsatisfactory seal between the vanes and top 11 may be produced with unacceptable air leakage into the reservoir. This leakage could interfere with the achievement of, or require greater energy to achieve, the desired hydraulic head H.

Figure 3:
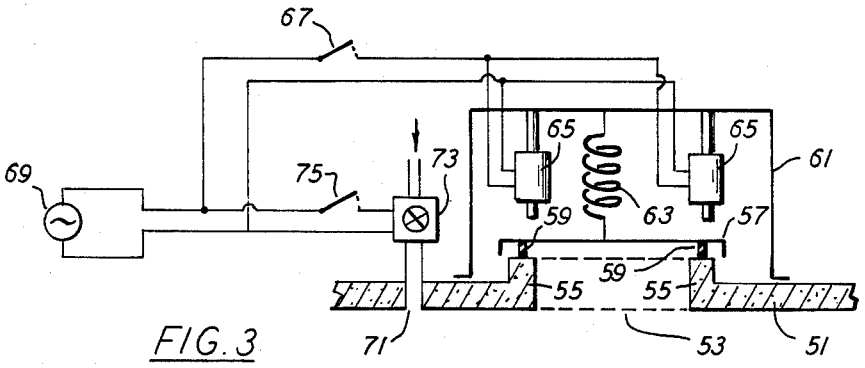
FIG. 3 is a schematic, cross sectional side view of a preferred embodiment of a valve according to the invention.

An alternative form of valve is shown schematically in FIG. 3. There the top wall or ceiling 51 of a reservoir is shown in cross section having a relatively large opening 53. Wall 51 has an upstanding portion 55 which may be circular as illustrated. A lid 57 covers opening 53 and a gasket 59 of rubber or other suitable compressible material forms an air-tight seal between lid 57 and wall portion 55 when they are held together. A frame 61 is mounted on top of wall 51 to support a helical spring 63 that is connected to lid 57. When lid 57 is in its closed position as shown, spring 63 is in tension and urges the lid toward its open position. Two solenoids 65 also are supported on frame 61 and have their plungers disposed opposite lid 57. When the plungers are extended they engage lid 57 to urge it toward its closed position and place the lid in contact with gasket 59. Solenoids 65 are connected through an electrical switch 67 to an electrical source 69. A second aperture 71 in wall 51 has a much smaller cross sectional area than opening 53. A valve 73, preferably a solenoid valve, is connected through piping to aperture 71 to the atmosphere. Valve 73 is electrically connected through a switch 75 to power source 69. In this valve embodiment, aperture 71 is used to control the release of cover 57. At the beginning of a wave cycle, switch 67 is closed and solenoids 65 depress lid 57 extending spring 63 to urge lid 57 upward. Valve 73 is closed, as is normal. The evacuation of air from the reservoir begins and atmospheric pressure seals lid 57 to wall portions 55. Switch 67 is opened. When the desired hydraulic head height H is reached, switch 75 is closed so that valve 73 is opened to the atmosphere. Air rushes through valve 73 in the direction indicated by the arrow quickly raising the pressure in the reservoir sufficiently to permit lid 57 to be opened by the force of spring 63. The opening of aperture 53 exposes sufficient area for the inflow of air that water flows down and out of the reservoir at a rate not restricted by the rate of airflow into the reservoir. In this embodiment it is important that the pressure within the reservoir rise quickly so that lid 57 is moved to the open position before a substantial amount of water flows out of the reservoir. If the delay between the openings of the aperture is less than about one second, the inertia of the water in the reservoir will aid in achieving the desired result. Without using a construction such as that just described, very large forces would be required to open lid 57 against atmospheric pressure since it must have a relatively large area to permit a rapid flow of a large volume of air into the reservoir. In practice, a small aperture such as 71 need only have an area of about 1 $m^2$ for a larger aperture total area of 70 $m^2$. If the areas are in a ratio between the range of 1 to 100 and 1 to 200, then the desired result is achieved. The same result might also be achieved mechanically by using a crankshaft linked to covers on the large and small apertures and arranged so that a cam opens the small aperture just prior to the opening of the large aperture by another cam.

Because the relatively large area that needs to be opened in a reservoir for the admission of air, for example 70 $m^2$ in a reservoir having a horizontal cross sectional area of 200 $m^2$, it may be preferred to use a number of valves in parallel. Such an arrangement is shown in FIG. 4 where top wall or ceiling 49 of a reservoir is shown. There, three large apertures 81, 83 and 85 are contained in wall 49 and each such aperture is accompanied by a smaller control aperture, 87, 89 and 91, respectively. Each of these aperture pairs would be fitted by a valve assembly as previously described or in a combined assembly in a form that would be obvious to one skilled in the art. It may also be desirable to use a single small, control aperture to reduce the cost of the apparatus and the possibility that the larger area covers might not open simultaneously. In any event, a total control aperture area of 1 $m^2$ should be adequate for the example of this paragraph.

The invention has been described with reference to certain preferred embodiments. Various modifications and additions within the spirit of the invention will occur to those of skill in their art. Accordingly, the scope of the invention is limited solely by the following claims.

We claim:

1. Apparatus for producing a surfing wave above the undisturbed level of water in a pool having a floor, said apparatus comprising:

a reservoir having an interior volume disposed partially above and partially below the level of undisturbed water in a pool, generally opposed front and rear walls, and generally opposed side walls to form with said front and rear walls a first horizontal cross sectional area, each said wall terminating in a lower extremity to establish communication between said reservoir and said pool below said level of undisturbed water in said pool, said reservoir including a first aperture for admitting air, said first aperture having a second cross sectional area at least one third that of said first horizontal cross sectional area;

suction means in communication with said reservoir for evacuating air from said reservoir; and valve means for selectively sealing said reservoir against the intrusion of air and rapidly opening said first aperture to ventilate said reservoir to the atmosphere.

2. The invention of claim 1 wherein said lower extremity of said interior surface of said front wall is disposed approximately at said level of undisturbed water in said pool.

3. The invention of claim 1 wherein the floor of said pool rises as the distance from said front wall increases.

4. The invention of claim 1, said valve means further comprising a butterfly valve including a rotatable axle, a vane mounted on said axle for selectively sealing and opening said first aperture and drive means for selectively rotating said axle.

5. The invention of claim 1, said reservoir including a second aperture having a third cross sectional area that is less than about one hundredth of said second cross sectional area, said valve means further comprising a cover having open and closed positions for selectively sealing and opening said first aperture, respectively, biasing means for urging said cover toward said open position, a valve for selectively opening said second aperture to the atmosphere to release said cover from said closed position and for sealing said second aperture to prevent intrusion of air into said reservoir.

6. A method for producing a surfing wave in a pool containing a depth of undisturbed water and having a reservoir including an interior horizontal cross section, and a first aperture having a first cross sectional area at least one third that of said horizontal cross sectional area, said reservoir being in communication with said pool beneath the surface of the undisturbed water, comprising the steps of:

sealing the reservoir against the intrusion of air;

removing air from the reservoir to draw water into the reservoir above the surface of the undisturbed water;

and rapidly opening said first aperture to the atmosphere.

7. The invention of claim 6, wherein said reservoir has a second aperture having a second cross sectional area less than about one hundredth of said first cross sectional area and said opening step comprises first opening said second aperture and subsequently opening said first aperture.

8. Apparatus for producing a surfing wave above the undisturbed level of water in a pool, said apparatus comprising: a reservoir having an interior volume disposed partially above and partially below the level of undisturbed water in a pool, in communication with said pool below said undisturbed level of water and containing first and second apertures, said first aperture having an area less than about 1/100 of said second aperture; suction means in communication with said reservoir for evacuating air from said reservoir; sealing means having closed and open positions for selectively sealing said second aperture from the flow of air and opening said second aperture to the atmosphere, respectively; biasing means for urging said sealing means toward said open position; and first aperture opening means for selectively sealing said first aperture from the flow of air and opening said first aperture to the atmosphere in response to a stimulus to release said sealing means from said closed position.

9. The invention of claim 8 wherein said first aperture opening means comprises a solenoid valve.

10. The invention of claim 9 wherein said biasing means comprises a helical spring and said sealing means comprises a lid for covering said second aperture.

* * * * *